US010561179B1

(12) United States Patent
Ortiz

(10) Patent No.: US 10,561,179 B1
(45) Date of Patent: Feb. 18, 2020

(54) WEARABLE PEDESTRIAN SAFETY LIGHT

(71) Applicant: Jesus Ortiz, Fullerton, CA (US)

(72) Inventor: Jesus Ortiz, Fullerton, CA (US)

( * ) Notice: Subject to any disclaimer, the term of this patent is extended or adjusted under 35 U.S.C. 154(b) by 0 days.

(21) Appl. No.: 16/436,659

(22) Filed: Jun. 10, 2019

(51) Int. Cl.

| | |
|---|---|
| ***F21V 21/00*** | (2006.01) |
| ***A41D 13/01*** | (2006.01) |
| ***A41D 1/04*** | (2006.01) |
| ***G08B 5/00*** | (2006.01) |
| ***F21V 23/02*** | (2006.01) |
| ***F21V 33/00*** | (2006.01) |
| ***F21V 7/04*** | (2006.01) |
| ***F21V 15/01*** | (2006.01) |
| ***F21V 23/04*** | (2006.01) |
| *F21W 111/10* | (2006.01) |
| *F21Y 105/16* | (2016.01) |

(52) U.S. Cl.
CPC ..... *A41D 13/01* (2013.01); *A41D 1/04* (2013.01); *F21V 7/045* (2013.01); *F21V 15/012* (2013.01); *F21V 23/023* (2013.01); *F21V 23/0407* (2013.01); *F21V 33/0008* (2013.01); *G08B 5/004* (2013.01); *F21W 2111/10* (2013.01); *F21Y 2105/16* (2016.08)

(58) Field of Classification Search
CPC ..... F21V 7/045; F21V 15/012; F21V 23/023; F21V 23/0407; F21V 33/0008; G08B 5/004; F21Y 2105/16; F21W 2111/10; A41D 13/01; A41D 1/04
USPC ..... 362/108, 103
See application file for complete search history.

(56) References Cited

U.S. PATENT DOCUMENTS

| | | | | |
|---|---|---|---|---|
| 4,570,206 | A * | 2/1986 | Deutsch | A41D 27/085 2/115 |
| 4,709,307 | A | 11/1987 | Branom | |
| 5,070,436 | A | 12/1991 | Alexander | |
| 5,128,843 | A * | 7/1992 | Guritz | A41D 27/085 362/103 |
| 5,249,106 | A | 9/1993 | Barnes | |
| 6,834,395 | B2 | 12/2004 | Fuentes | |
| 7,758,200 | B2 * | 7/2010 | Tuan | F21V 33/0008 362/103 |
| D624,247 | S | 9/2010 | Thind | |
| 8,616,719 | B1 * | 12/2013 | Barze | A41D 13/01 362/103 |
| 2002/0145864 | A1 * | 10/2002 | Spearing | A41D 13/01 362/103 |
| 2008/0043458 | A1 * | 2/2008 | Desjardin | A41D 13/01 362/108 |

(Continued)

FOREIGN PATENT DOCUMENTS

WO WO2008043103 4/2008

*Primary Examiner* — Laura K Tso

(57) ABSTRACT

A wearable pedestrian safety light for improved pedestrian visibility at night includes a light housing configured to couple to an outerwear garment. A light array is coupled to the light housing and comprises a plurality of lights. A battery housing has an inner compartment and a control wire extending to the light array. A rechargeable battery pack and a microprocessor are coupled within the inner compartment and are in operational communication with the light array via the control wire. A control switch is coupled to the battery housing and is in operational communication with the rechargeable battery pack, the microprocessor, and the light array to activate and alternatively deactivate the light array.

12 Claims, 5 Drawing Sheets

(56) References Cited

U.S. PATENT DOCUMENTS

| | | | | |
|---|---|---|---|---|
| 2008/0080172 | A1* | 4/2008 | Mayo | A41D 13/01 362/106 |
| 2008/0089056 | A1 | 4/2008 | Grosjean | |
| 2009/0134992 | A1* | 5/2009 | Pacheco | B60Q 1/2665 340/479 |
| 2010/0124049 | A1* | 5/2010 | Fabian | A41D 13/01 362/108 |
| 2011/0235311 | A1 | 9/2011 | Stone | |
| 2014/0340877 | A1* | 11/2014 | Nelson | F21V 33/0008 362/103 |
| 2014/0355257 | A1* | 12/2014 | Anteby | A41D 13/01 362/108 |
| 2015/0016095 | A1 | 1/2015 | Kretzu | |
| 2016/0015102 | A1* | 1/2016 | Fonte | F21V 33/0008 362/108 |

* cited by examiner

WEARABLE PEDESTRIAN SAFETY LIGHT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to safety vests and more particularly pertains to a new safety vest for improved pedestrian visibility at night.

BRIEF SUMMARY OF THE INVENTION

An embodiment of the disclosure meets the needs presented above by generally comprising a light housing configured to couple to an outerwear garment. A light array is coupled to the light housing and comprises a plurality of lights. A battery housing has an inner compartment and a control wire extending to the light array. A rechargeable battery pack and is coupled within the inner compartment and is in operational communication with the light array via the control wire. A microprocessor is coupled within the inner compartment and is in operational communication with the light array and the rechargeable battery pack. A control switch is coupled to the battery housing and is in operational communication with the rechargeable battery pack, the microprocessor, and the light array to activate and alternatively deactivate the light array.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
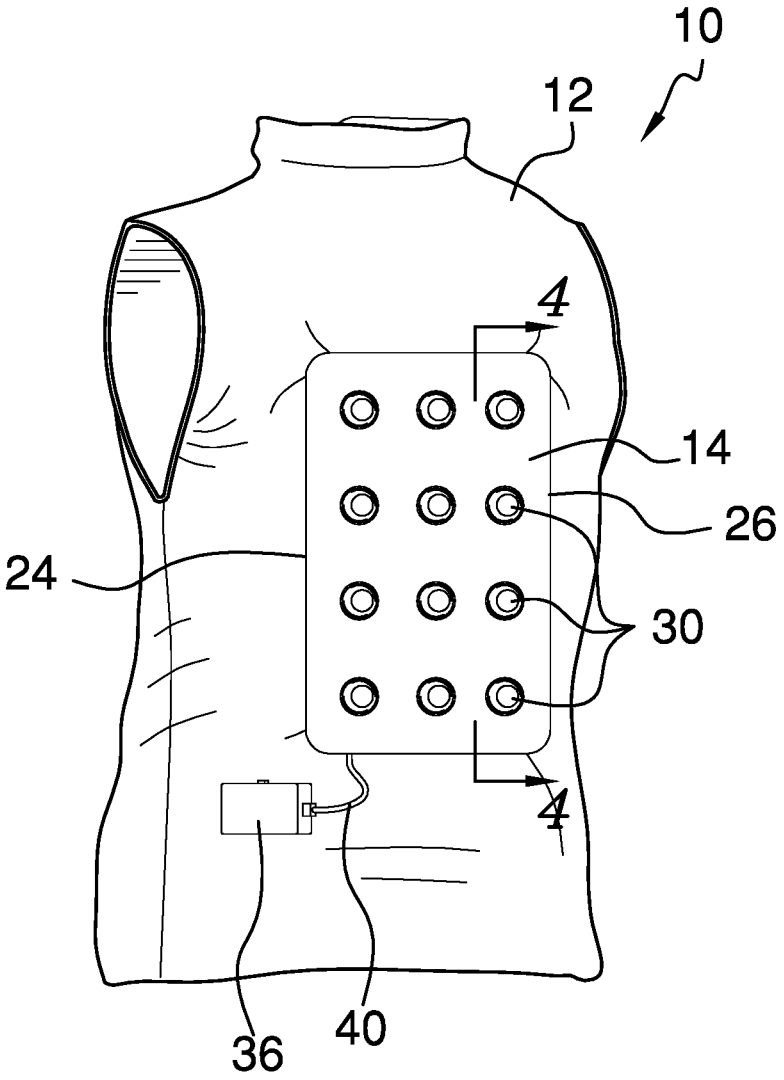
FIG. 1 is an isometric view of a wearable pedestrian safety light according to an embodiment of the disclosure.
Figure 2:
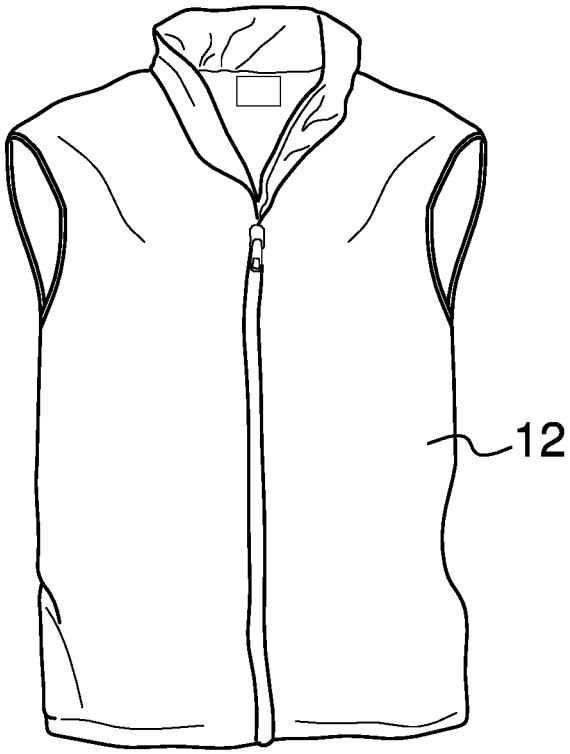
FIG. 2 is a front elevation view of an embodiment of the disclosure.
Figure 3:
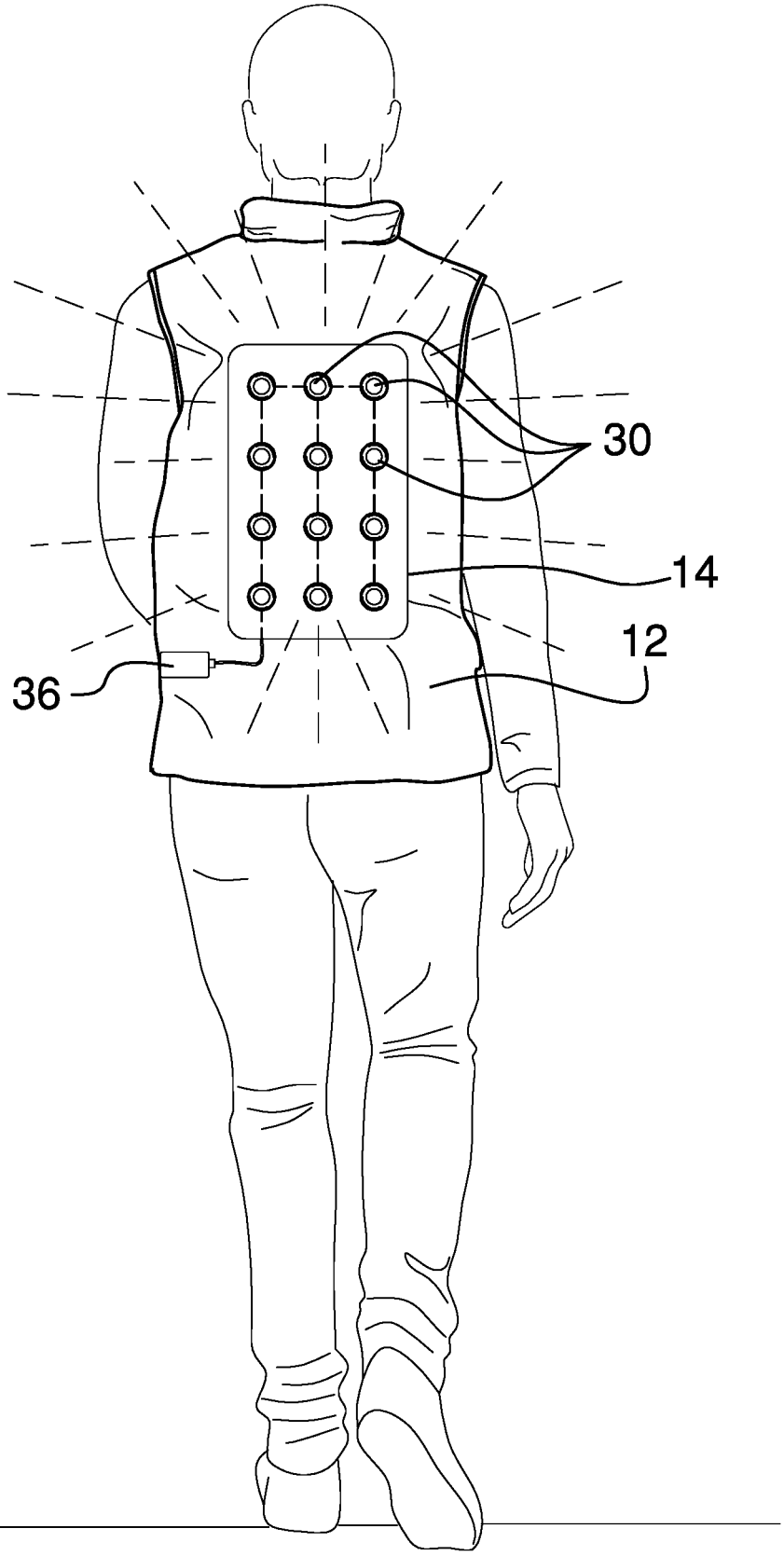
FIG. 3 is a rear elevation view of an embodiment of the disclosure.
Figure 4:
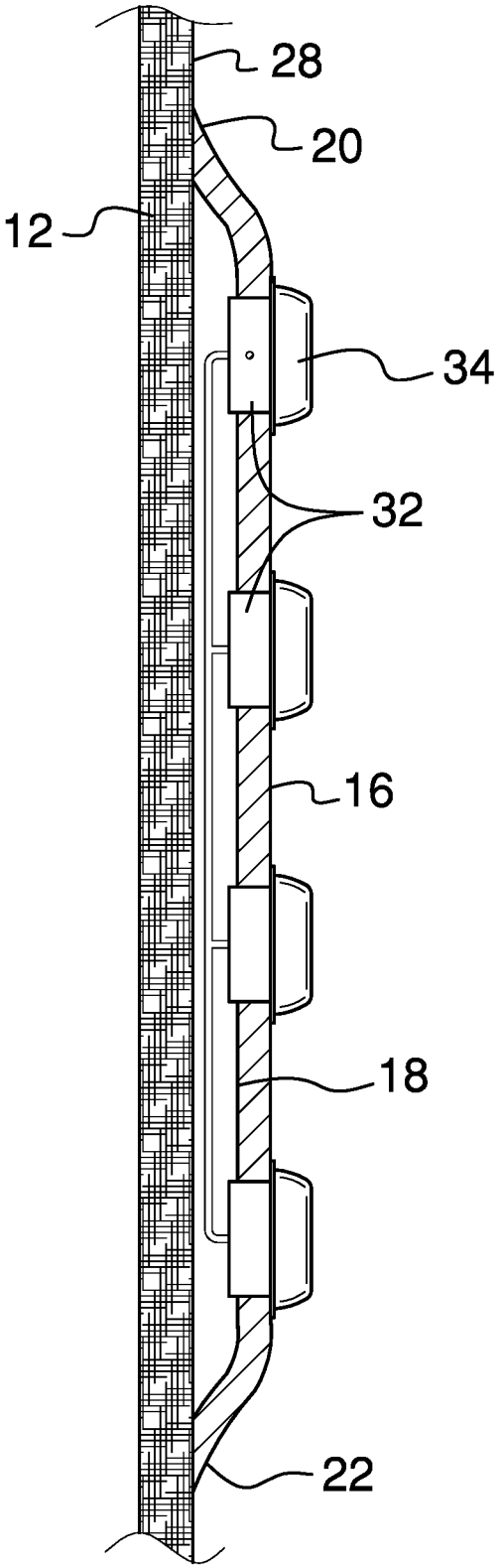
FIG. 4 is a cross-sectional view of an embodiment of the disclosure along line 4-4 of FIG. 1.
Figure 5:
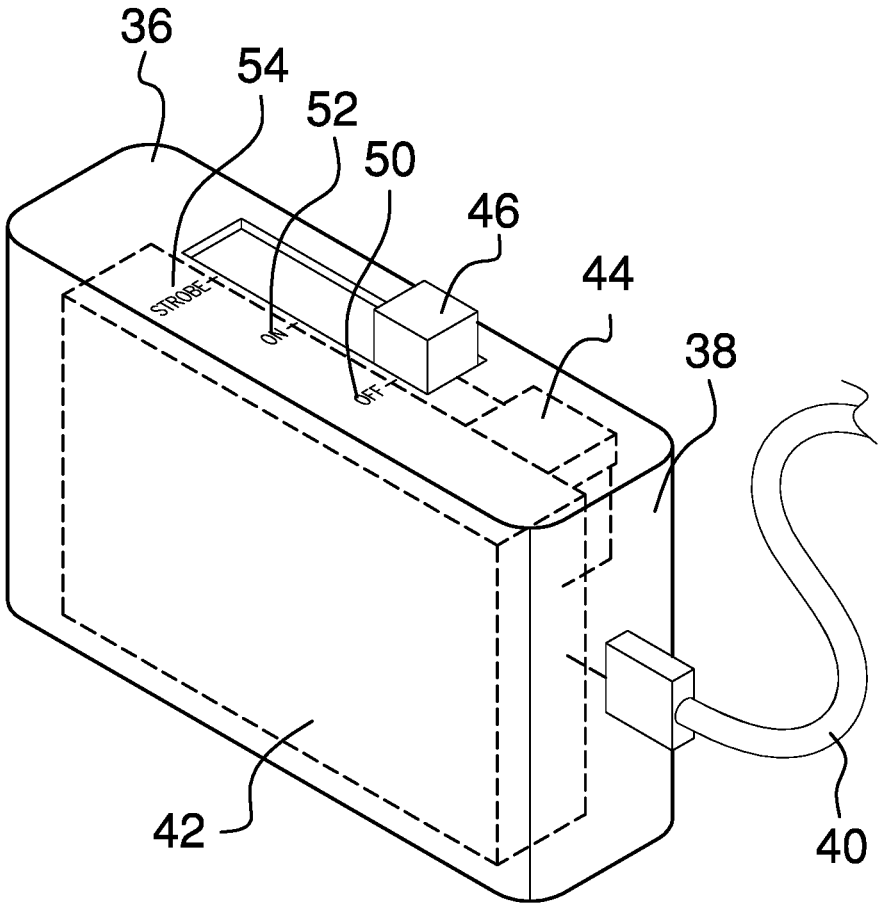
FIG. 5 is a detail view of an embodiment of the disclosure.

With reference now to the drawings, and in particular to FIGS. 1 through 5 thereof, a new safety vest embodying the principles and concepts of an embodiment of the disclosure and generally designated by the reference numeral 10 will be described.

As best illustrated in FIGS. 1 through 5, the wearable pedestrian safety light 10 generally comprises a vest 12 and a light housing 14 coupled to the vest 12. The light housing 14 has a front side 16, a rear side 18, a top edge 20, a bottom edge 22, a left edge 24, and a right edge 26. The light housing 14 may be rectangular and may have rounded corners and is flexible such that it conforms to a wearer's body movements. Each of the top edge 20, the bottom edge 22, the left edge 24, and the right edge 26 is coupled to a backside 28 of the vest with the rear side 18 being separated from the vest 12. A light array 30 is coupled to the light housing 14. The light array 30 extends from the front side 16 through the rear side 18 and comprises a plurality of lights 32 which may be arranged in a rectangular matrix. Each of the plurality of lights 32 has a reflective cover 34 coupled to the front side 16 of the light housing. The reflective cover 34 may be a truncated hemisphere.

A battery housing 36 has an inner compartment 38 and a control wire 40 extending to the light array 30. The battery housing 36 may be rectangular prismatic and may be coupled to the vest 12 or held in a wearer's pocket. A rechargeable battery pack 42 is coupled within the inner compartment 38 and is in operational communication with the light array 30 via the control wire 40. A microprocessor 44 is coupled within the inner compartment 38 and is in operational communication with the light array 30 and the rechargeable battery pack 42. A control switch 46 is coupled through a top surface 48 of the battery housing 36 and is in operational communication with the rechargeable battery pack 42, the microprocessor 44, and the light array 30. The control switch 46 may have an off position 50 to deactivate the light array 30, an on position 52 to activate the light array 30, and a strobe position 54 to pulse the light array 30.

In use, the vest 12 is worn while walking or running on the street with the control switch 46 in the on position 52 or the strobe position 54 to increase visibility to drivers and prevent accidents.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wearable pedestrian safety light comprising:

a light housing having a front side, a rear side, a top edge, a bottom edge, a left edge and a right edge, the light housing being configured to couple to an outerwear garment;

a light array coupled to the light housing, the light array extending from the front side through the rear side, the light array comprising a plurality of lights;

a battery housing having an inner compartment, the battery housing having a control wire extending to the light array;

a rechargeable battery pack coupled to the battery housing, the rechargeable battery pack being coupled within the inner compartment, the rechargeable battery pack being in operational communication with the light array via the control wire;

a microprocessor coupled to the battery housing, the microprocessor being coupled within the inner compartment, the microprocessor being in operational communication with the light array and the rechargeable battery pack; and a control switch coupled to the battery housing, the control switch being in operational communication with the rechargeable battery pack, the microprocessor, and the light array to activate and alternatively deactivate the light array.

2. The wearable pedestrian safety light of claim 1 further comprising each of the plurality of lights having a reflective cover coupled to the front side of the light housing.

3. The wearable pedestrian safety light of claim 2 further comprising the reflective cover being a truncated hemisphere.

4. The wearable pedestrian safety light of claim 1 further comprising the light housing being flexible such that it conforms to a wearer's body movements, each of the top edge, the bottom edge, the left edge and the right edge being coupled to a backside of the outerwear garment and the rear side being separated from the outerwear garment.

5. The wearable pedestrian safety light of claim 1 further comprising the light housing being rectangular and having rounded corners.

6. The wearable pedestrian safety light of claim 5 further comprising the light array being a rectangular matrix.

7. The wearable pedestrian safety light of claim 1 further comprising the battery housing being rectangular prismatic, the control switch being coupled through a top surface of the battery housing.

8. The wearable pedestrian safety light of claim 7 further comprising the control switch being a slider switch.

9. The wearable pedestrian safety light of claim 1 further comprising the control switch having an off position to deactivate the light array, an on position to activate the light array, and a strobe position to pulse the light array.

10. A wearable pedestrian safety light comprising:

a light housing having a front side, a rear side, a top edge, a bottom edge, a left edge and a right edge, the light housing being rectangular and having rounded corners, the light housing being flexible such that it conforms to a wearer's body movements, each of the top edge, the bottom edge, the left edge and the right edge being configured to couple to a backside of an outerwear garment with the rear side being separated from the outerwear garment;

a light array coupled to the light housing, the light array extending from the front side through the rear side, the light array comprising a plurality of lights in a rectangular matrix, each of the plurality of lights having a reflective cover coupled to the front side of the light housing, the reflective cover being a truncated hemisphere;

a battery housing having an inner compartment, the battery housing being rectangular prismatic and having a control wire extending to the light array;

a rechargeable battery pack coupled to the battery housing, the rechargeable battery pack being coupled within the inner compartment, the rechargeable battery pack being in operational communication with the light array via the control wire;

a microprocessor coupled to the battery housing, the microprocessor being coupled within the inner compartment, the microprocessor being in operational communication with the light array and the rechargeable battery pack; and a control switch coupled to the battery housing, the control switch being a slider switch coupled through a top surface of the battery housing, the control switch being in operational communication with the rechargeable battery pack, the microprocessor, and the light array, the control switch having an off position to deactivate the light array, an on position to activate the light array, and a strobe position to pulse the light array.

11. A combination vest and wearable pedestrian safety light comprising:

a vest;

a light housing coupled to the vest, the light housing having a front side, a rear side, a top edge, a bottom edge, a left edge and a right edge, the light housing being rectangular and having rounded corners, the light housing being flexible such that it conforms to a wearer's body movements, each of the top edge, the bottom edge, the left edge and the right edge being coupled to a backside of the vest with the rear side being separated from the vest;

a light array coupled to the light housing, the light array extending from the front side through the rear side, the light array comprising a plurality of lights in a rectangular matrix, each of the plurality of lights having a reflective cover coupled to the front side of the light housing, the reflective cover being a truncated hemisphere;

a battery housing having an inner compartment, the battery housing being rectangular prismatic and having a control wire extending to the light array;

a rechargeable battery pack coupled to the battery housing, the rechargeable battery pack being coupled within the inner compartment, the rechargeable battery pack being in operational communication with the light array via the control wire;

a microprocessor coupled to the battery housing, the microprocessor being coupled within the inner compartment, the microprocessor being in operational communication with the light array and the rechargeable battery pack; and a control switch coupled to the battery housing, the control switch being a slider switch coupled through a top surface of the battery housing, the control switch being in operational communication with the rechargeable battery pack, the microprocessor, and the light array, the control switch having an off position to deactivate the light array, an on position to activate the light array, and a strobe position to pulse the light array.

12. The wearable pedestrian safety light of claim 11 further comprising the vest being zippered.

* * * * *